US005855064A

United States Patent [19]

Chang

[11] Patent Number: 5,855,064

[45] Date of Patent: Jan. 5, 1999

[54] METHOD OF MAKING PERSONAL COMPUTER POWER SUPPLY SYSTEMS

[75] Inventor: Shu-Ching Chang, Nantou, Taiwan

[73] Assignee: Delta Electronics, Inc., Taipei, Taiwan

[21] Appl. No.: 784,782

[22] Filed: Jan. 16, 1997

Related U.S. Application Data

[62] Division of Ser. No. 249,145, May 25, 1994, abandoned.

[51] Int. Cl.[6] ..... H01R 43/04

[52] U.S. Cl. ..... 29/861; 361/683; 361/685; 361/686; 439/502; 439/505; 439/638; 439/650

[58] Field of Search ..... 439/502, 505, 439/638, 650, 655; 361/683, 685, 686; 29/861

[56] References Cited

U.S. PATENT DOCUMENTS

| | | |
|---|---|---|
| 2,994,849 | 8/1961 | Mossari, Jr. . |
| 4,386,333 | 5/1983 | Dillan . |
| 4,479,198 | 10/1984 | Romano et al. . |
| 4,602,164 | 7/1986 | Gore, III et al. . |
| 4,922,125 | 5/1990 | Casanova et al. . |
| 5,051,868 | 9/1991 | Levérault . |
| 5,217,394 | 6/1993 | Ho . |
| 5,333,098 | 7/1994 | DeLuca et al. . |
| 5,392,192 | 2/1995 | Donn et al. . |

FOREIGN PATENT DOCUMENTS

| | | |
|---|---|---|
| 1079064 | 12/1993 | China . |

*Primary Examiner*—Carl J. Arbes
*Attorney, Agent, or Firm*—Bo-In Lin

[57] ABSTRACT

The present invention discloses a power supply system with modularized and integrated cable interface configuration for providing power from an external power source to a plurality of subsystems in a personal computer. The power supply system includes a power cable for connecting the power supply system to the external power source. The power supply system further includes an output (O/P) cable having a first end and second end, the O/P cable including a plurality of cable groups wherein each of the cable groups including a subsystem plug module on the first end for connecting to a corresponding PC subsystems. The power supply system further includes an integrated PC receptive module for providing an interface with the O/P cable. The O/P cable further including an integrated O/P cable plug module on the second end for plugging the O/P cable into the integrated receptive module, wherein the integrated O/P plug module being in electric connection to each of the cable groups. The O/P cable of the power supply system may be conveniently removed and separately designed and manufactured for connection to different types of the personal computers. In another preferred embodiment, the integrated PC receptive module is a standardized module suitable for providing power to many different types for the PC subsystems by utilizing different designs and combinations of the O/P cable groups.

10 Claims, 8 Drawing Sheets

METHOD OF MAKING PERSONAL COMPUTER POWER SUPPLY SYSTEMS

This patent application is a Divisional application of parent patent application Ser. No. 08/249,145 filed on May 25, 1994, abandoned. The original claims which were cancelled in response to a Restriction Requirement from Examiner are now included in this Application.

BACKGROUND OF THE INVENTION

1. Field of the Invention

This invention relates generally to an power supply system for a personal computer. More particularly, this invention relates to a new design approach to power supply system with a modularized and integrated cable interface for connecting a plurality of interface cable-groups to an external power source for providing power to each subsystem of a personal computer.

2. Description of the Prior Art

The power supply system for a personal computer are required to provide power to increasingly more 'peripheral equipment', such as modem-facsimile, compact disk (C-D) driver, scanners, hard-disk drives, floppy disk drives, etc. Due to current trend of development in personal computers, it can be expected that such trend will continue. Especially when the microprocessor which is generally referred to as the central processing unit (CPU) are becoming more powerful to manage multi-media, multi-task functions. In addition to the this trend, each type and model of personal computers often has unique arrangement and configuration by placing these peripheral equipments in different locations. In order to satisfy this very complicate power supply requirements, a power supply system including the power cable and the interface connectors are required to be custom designed to uniquely meet the specifications of each model of computer system design.

FIG. 1 shows a prior art power supply system 10 which includes several groups of output (O/P) cables, i.e., cable groups 15-1, 15-2, 15-3, and 15-4 for connecting to the CPU and various different peripheral equipments such as hard-disk derive, floppy disk drive, monitor, and modem-facsimile board. The power supply system also has a power cable 20 for connecting to an external power source connector 25. The external power source connector is typically installed at the back-panel of a personal computer for connecting to an external source via a power line (not shown). Depending on the internal space arrangement, the power supply system 10 for a personal computer can be located at different positions in a personal computer system. The length of the power cable 20 and those of the O/P cable groups 15-1, 15-2, 15-3, and 15-4 are all different. For this reason, the general practice in manufacturing the power supply system for a personal computer is to custom design and then 'tailor-make' those cables and group them in accordance with the specifications of each purchase order.

One example of these power supply systems is ASTEC's power supply Model AS145-3420 which has output cable connection and output cable groups as that shown in FIGS. 2A and 2B for an IBM personal computer. FIG. 2A is a side view of a power supply wherein a plurality of output cables from the AS145-3420 power supply is connected directly from the power supply unit near the top of the panel along a surface in the A–A' direction. The output-cable connection 40 of this power supply AS145-3420 unit is the same as that shown in FIG. 1. FIG. 2B shows the detail groupings of these output cables, i.e., cable groups 45-1 to 45-6. Since the groupings of these output cables 45-1 to 45-6 may be different for different model of computers, this Model AS145-3420 power supply shows a typical design approach generally used. Because ASTEC is one of the major power supply companies for the personal computers worldwide while IBM has continuously dominated the PC market share, the design method as shown for ASTEC145-3420 demonstrates the level of ordinary skill in the art of power supply design in the particular field pertinent to the personal computer systems.

Therefore, there is still a need for a new system configuration and design method in the art of power-supply design and manufacture in order to resolve these difficulties and limitations. Specifically, this new system configuration and design approach must be able to provide a more flexible scheme to satisfy different customer's requirements in providing power to many subsystems in a personal computer which may be arranged in many different ways according to the packaging layout, the level of integration, the performance level, the intended computer functions and a wide variety of other design considerations that the computer system designer may take into account.

SUMMARY OF THE PRESENT INVENTION

It is therefore an object of the present invention to provide a power supply system with modularized and integrated cable interface configuration and design method to overcome the aforementioned difficulties encountered in the prior art.

Specifically, it is an object of the present invention to provide a power supply system with cable interface configuration and design method which allow more flexibility in satisfying customer's requirements in providing power to every subsystem in a personal computer that may be differently configured.

Another object of the present invention is to provide a power supply system with cable interface configuration and design method which allow more flexibility such that the cost of custom design and manufacture for each product model may be reduced.

Another object of the present invention is to provide a power supply system with cable interface configuration and design method which allow more flexibility such that the cost of inventory and shipment may be reduced.

Another object of the present invention is to provide a power supply system with cable interface configuration and design method which allow more flexibility in order to shorten the manufacture's response time to the customer's requirements for providing the power supply systems to different models of personal computers.

Briefly, in a preferred embodiment, the present invention comprises a power supply system with modularized and integrated cable interface configuration for providing power from an external power source to a plurality of subsystems in a personal computer. The power supply system includes a power cable for connecting the power supply system to the external power source. The power supply system further includes an output (O/P) cable having a first end and second end, the O/P cable including a plurality of cable groups wherein each of the cable groups including a subsystem plug module on the first end for connecting to a corresponding PC subsystems. The power supply system further includes an integrated PC receptive module for providing an interface with the O/P cable. The O/P cable further including an integrated O/P cable plug module on the second end for plugging the O/P cable into the integrated receptive module, wherein the integrated O/P plug module being in electric connection to each of the cable groups. The O/P cable of the power supply system may be conveniently removed and separately designed and manufactured for connection to different types of the personal computers. In another preferred embodiment, the integrated PC receptive module is a standardized module suitable for providing power to many different types for the PC subsystems by utilizing different designs and combinations of the O/P cable groups.

It is an advantage of the present invention that it provides a power supply system with cable interface configuration and design method which allow more flexibility in satisfying customer's requirements in providing power to every subsystem in a personal computer that may be differently configured.

Another advantage of the present invention is that it provides a power supply system with cable interface configuration and design method which allow more flexibility such that the cost of custom design and manufacture for each product model may be reduced.

Another advantage of the present invention is that it provides a power supply system with cable interface configuration and design method which allow more flexibility such that the cost of inventory and shipment may be reduced.

Another advantage of the present invention is that it provides a power supply system with cable interface configuration and design method which more flexibility in order to shorten the manufacture's response time to the customer's requirements for providing the power supply systems to different models of personal computers.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
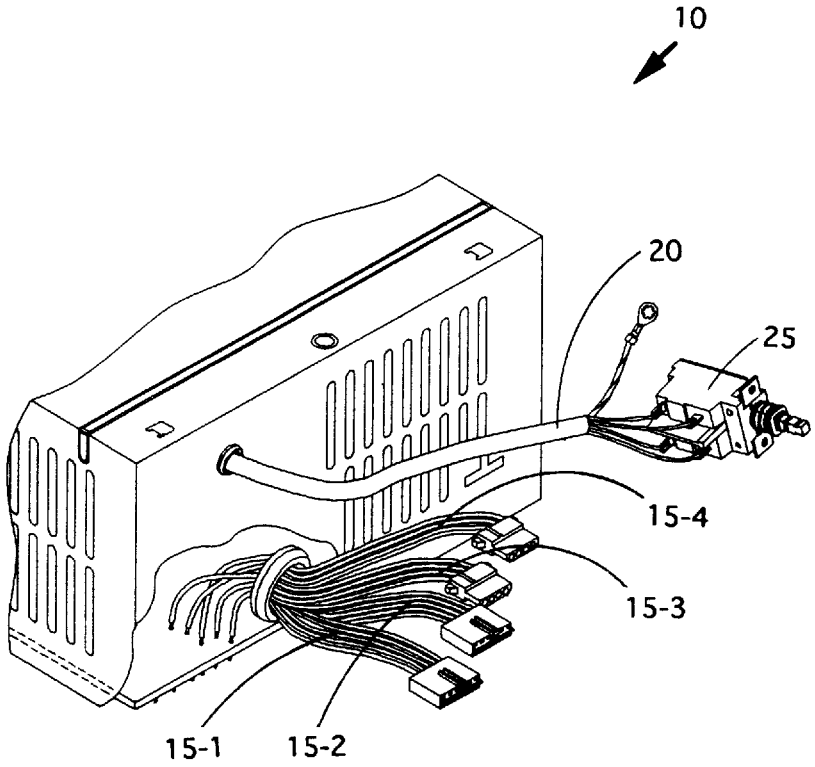
FIG. 1 (Prior Art)
FIG. 1 is a partial perspective view of a prior art power supply system.
Figure 2A:
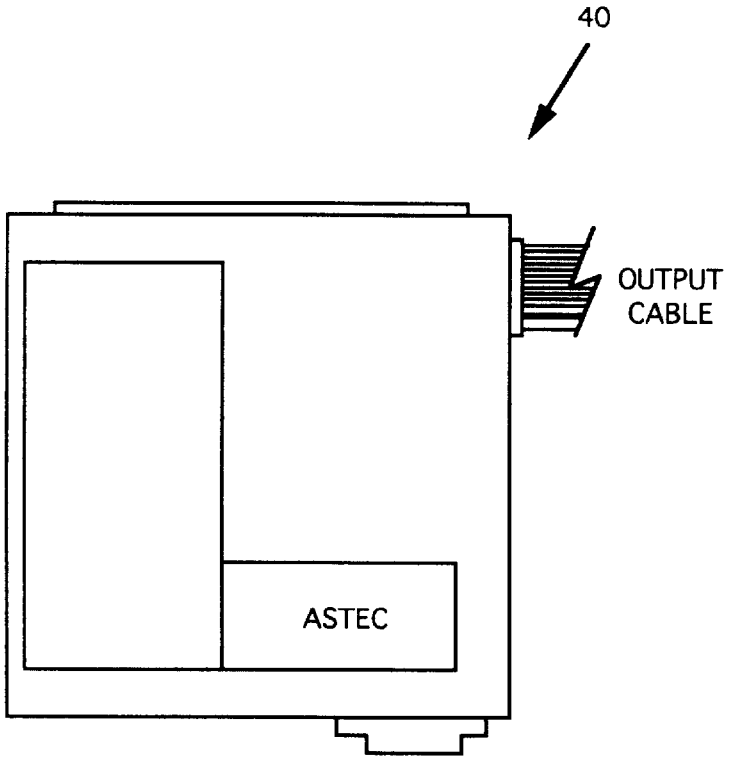
FIG. 2A (Prior Art)
FIG. 2A is a side view of another prior art power supply system showing the connection of the output cables to the power supply system.
Figure 2B:
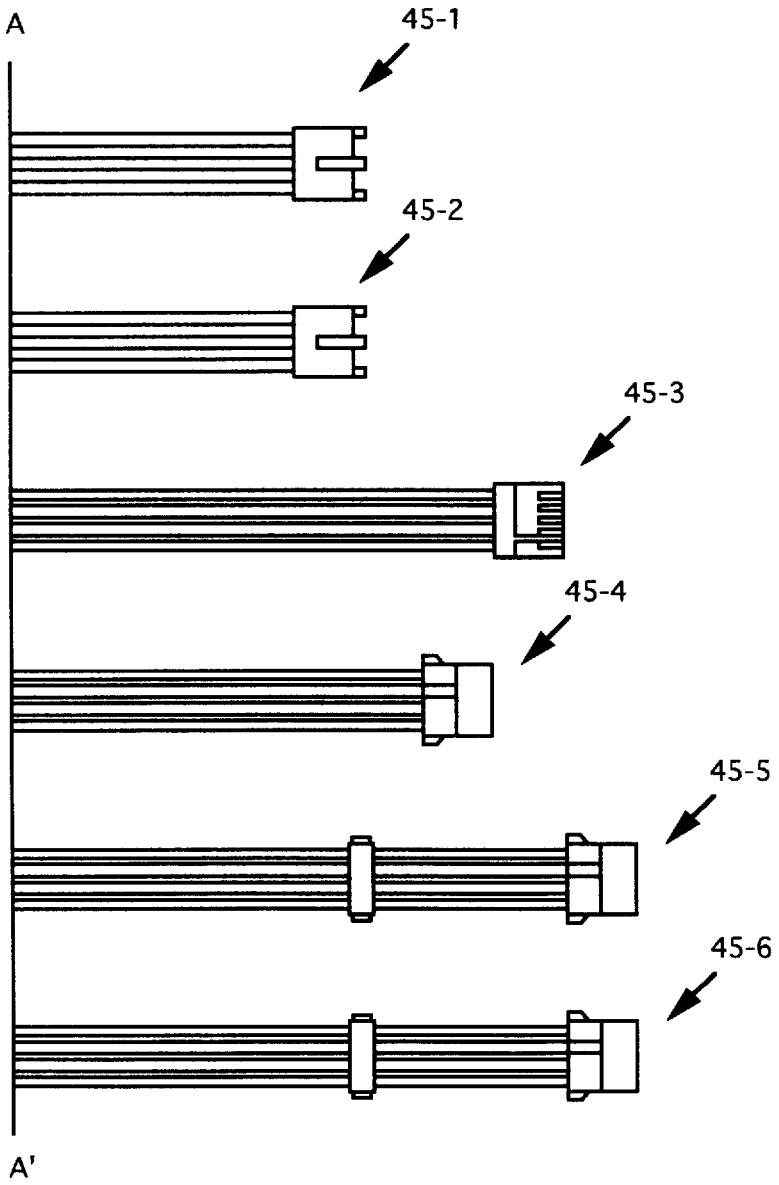
FIG. 2B (Prior Art)
FIG. 2B is a cable diagram showing the output cable groups of the power supply system of FIG. 2A.
Figure 3:
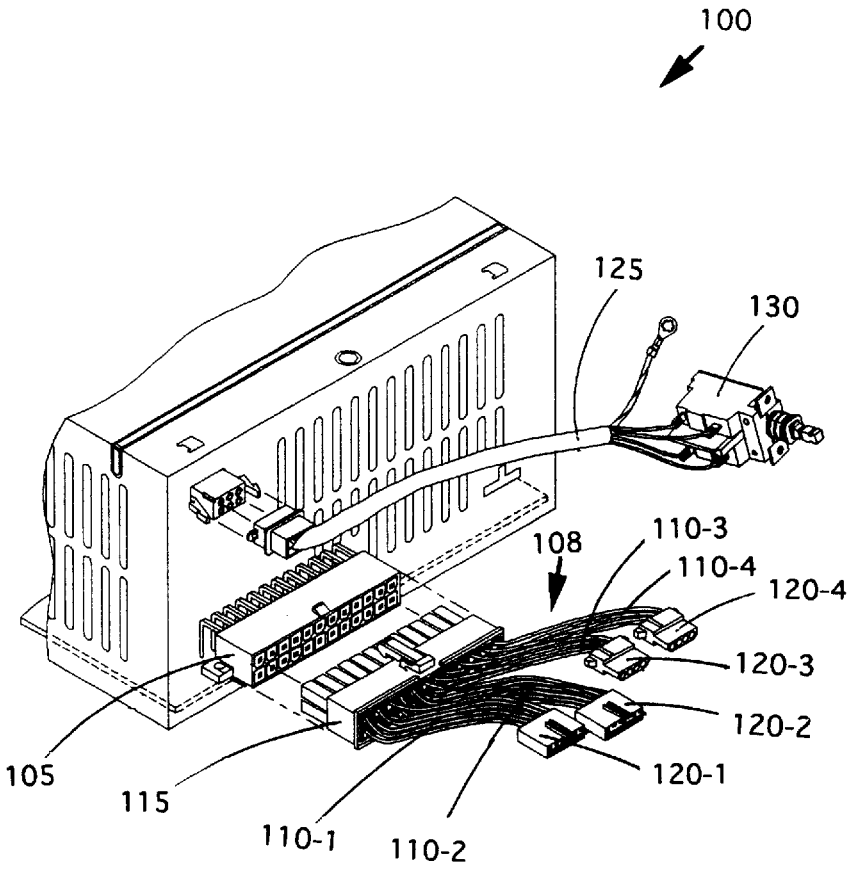
FIG. 3 is a partial perspective view of a power supply system according to the present invention.

FIG. 3 shows a perspective view of a power supply system 100 of the present invention. The power supply system 100 includes an integrated personal-computer (PC) receptive module 105. The power supply system 100 also includes an O/P cable 110 which includes a plurality of power connecting lines grouped into several subsystem-cable groups, e.g., cable groups 110-1 to 110-4 wherein the power connecting lines in each subsystem cable group have two ends. In the first end, these power connecting lines in each subsystem groups are all combined for connecting to an integrated O/P cable plugging module 115. The integrated O/P cable plugging module 115 is designed for plugging into and securely attached to the integrated PC receptive module 105. On the second end, the power connecting lines in each subsystem cable group are integrated and connected to a subsystem power plug module, e.g., power plug modules 120-1 to 120-4. The subsystem power plug module, i.e., modules 120-1 to 120-4, are then employed for plugging into a corresponding subsystem (not shown), such as a hard disk drive, a monitor, etc. for providing the required power for system operation.

Figure 4C:
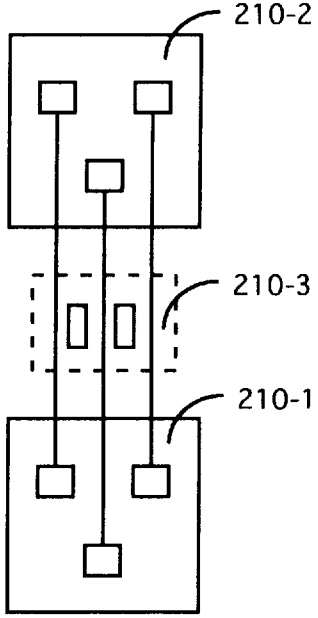
FIG. 4C shows a circuit diagram of the external power receptive module of the present invention.
Figure 4B:
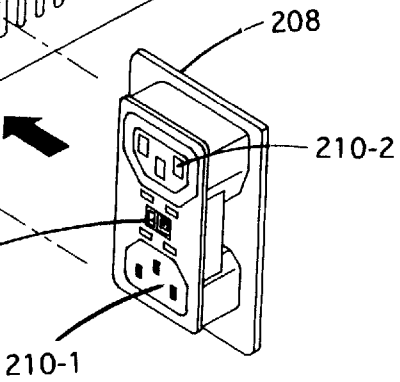
FIGS. 4A and 4B are partial perspective views of a personal computer power supply and the external power receptive module installed on the back panel of the personal computer power supply.
Figure 4A:
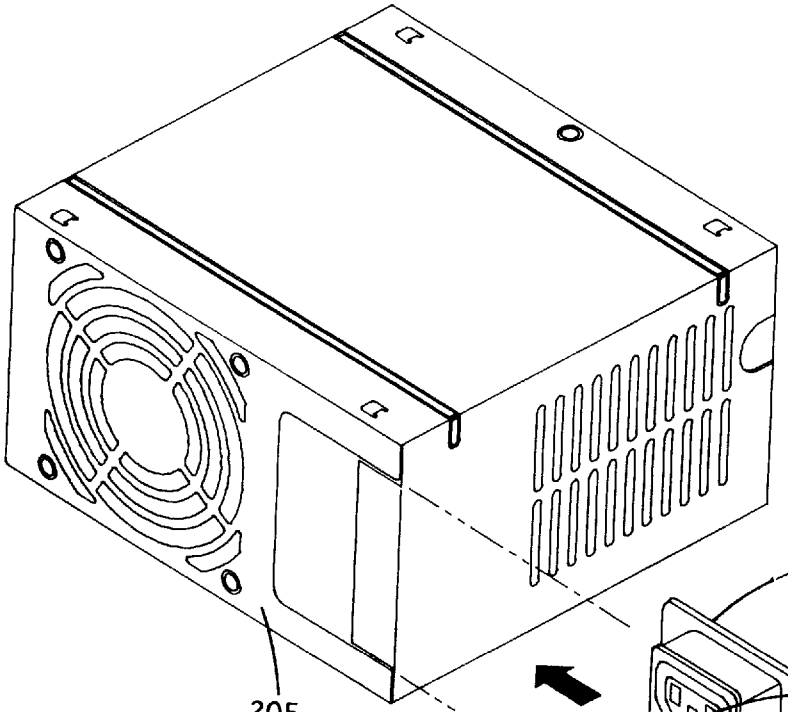

The power supply system 100 further includes a power cable receptive module 122 and a power cable 125. The power cable 125 has two ends, on the first end, it has a power cable plugging module 124 for plugging into the receptive module 122. On the second end, the power cable 125 has an external power receptive module 130, typically affixed on the back panel of a personal computer for connecting to an external power source (not shown). FIG. 4A is a partial perspective view from the back panel of a personal computer 200. The external power interface module 208 as shown in FIG. 4B to be installed onto the back panel 205. For the purpose of more flexibly meeting customer's different specification, the external power receptive module 130 is designed to be a three-function module which provides a male plug unit 210-1, a female plug unit 210-2 and a 110/220-volt switch unit 210-3 allowing the interface module 208 to be connected to ether a 110 volts or a 220 volts voltage source. FIG. 4C shows the circuit diagram of the interface module 208 wherein the common voltage terminals, a positive, a negative and a ground terminal for the male unit 210-1 and the female unit 210-2 are connected together as one common terminal. By using the three-function module shown in FIGS. 4B and 4C for the external power interface module 208, savings in manufacturing cost and time are achieved because of the less time and materials are required in making this integrated unit than to design and manufacture two separate plug modules. Additionally, this three-function module 208 used in a power supply system 100 provides flexibility for application to different types of personal computer designs.

Referring to FIG. 3 again, the power supply system 100 according to the present invention includes the integrated O/P PC receptive module 105 coupled with the integrated O/P cable plugging module 115, and the power cable receptive module 122 coupled with the power cable plugging module 124. This system configuration allows the power system designer to more flexibly respond to customer requirements. The power supply module can be designed and manufactured in advance with a standard integrated PC receptive module 105 and standard power cable receptive module 122. The integrated PC receptive module can be designed with a standard such that the metal connecting pins contained therein are arranged to provide different level of voltages as often required in supplying power to different subsystems and peripherals of a personal computer. Depending on customer's specification for the power supply to be used with different model of personal computers, these requirements are then satisfied by specifically designing and manufacturing the O/P cable 110 and the power cable 125. The O/P cable is designed with different subsystem groups having different lengths and combination of connecting lines and the power cable 125 are designed with different length as each model of personal computers may require.

In summary, the present invention discloses a personal computer (PC) power supply system 100 for providing power from an external power source (not shown) to a plurality of PC subsystems (not shown). The power supply system 100 comprises a power cable 125 for connecting the power supply system to the external power source. The power supply system further includes an output (O/P) cable 108 having a first end and second end, the O/P cable including a plurality of cable groups, e.g.., groups 110-1, 110-2, 110-3, and 110-4, wherein each of the cable groups 110-1 to 110-4 including a subsystem plug module, e.g., 120-1 to 120-4 on the first end for connecting to a corresponding PC subsystems. The power supply system further includes an integrated PC receptive module 105 for providing an interface with the O/P cable 108. The O/P cable 108 further includes an integrated O/P cable plug module 115 on the second end for plugging the O/P cable 108 into the integrated receptive module 105, wherein the integrated O/P plug module 115 being in electric connection to each of the cable groups, e.g., 110-1 to 110-4. The O/P cable 108 of the power supply system 100 may be conveniently removed and separately designed and manufactured for connection to different types of the personal computers. In another preferred embodiment, the integrated PC receptive module 105 is a standardized module with standard pin configurations suitable for providing power to many different types for the PC subsystems by utilizing different designs and combinations of the O/P cable groups. In another preferred embodiment, the integrated PC receptive module 105 is a female type module and the integrated O/P cable plugging module 115 is a corresponding male type module. In another preferred embodiment, the PC power supply system 100 further includes a power cable receptive module 122 and the power cable 125 further includes a power cable plugging module 124 for plugging the power cable 125 into the power cable receptive module 122 wherein the power cable 125 may be conveniently removed from the power supply system 100 and be separately designed and manufactured. In a preferred embodiment, the power cable receptive module 122 is a female type module and the power cable plugging module 124 is a corresponding male type module. In another preferred embodiment, the PC power supply system 100 further comprises a three-function module 208 including a male plug unit 210-1, a female plug unit 210-2, and a 110-volt/220-volt switch unit 210-3.

Figure 5:
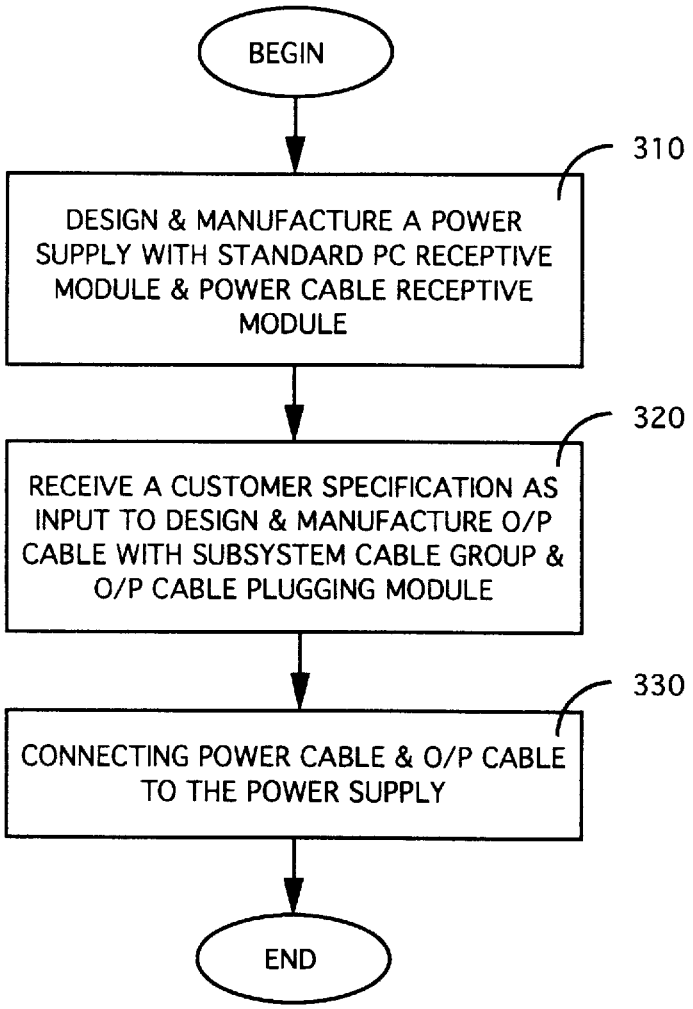
FIG. 5 is a flow chart showing the design process for designing the power supply system for customer's specifications according to the principles of the present invention.

Referring to FIG. 5 where a flow chart is used to show the design and manufacture processes used for a power supply system such as the system 100 for a personal computer. The power supply system 100 is designed and manufactured with standard PC receptive module 105 and the power cable receptive module 122 with standard size and pin connections (step 310). A customer specification is then received as input data for designing the O/P cable 110 with the integrated O/P cable plugging module 105, the subsystem cable groups 110-1, 110-2, etc. each with a corresponding subsystem power plug module 120-1, 120-2, etc, and the power cable 125 (step 320). Each of these cables may have different lengths and the O/P subgroup cable groups 110-1, 110-2, etc. may have various combinations of connecting lines depending on the specification provided by the requirements for incorporation into a personal computer system. The design and manufacturing of the power supply system 100 for the personal computer are completed after testing the power supply system 100 by connecting the power cable 125 and the O/P cable 110 via the integrated modules 105, 115, 122 and 124 as a completed and integrated power supply system 100 (step 330).

Figure 6A:
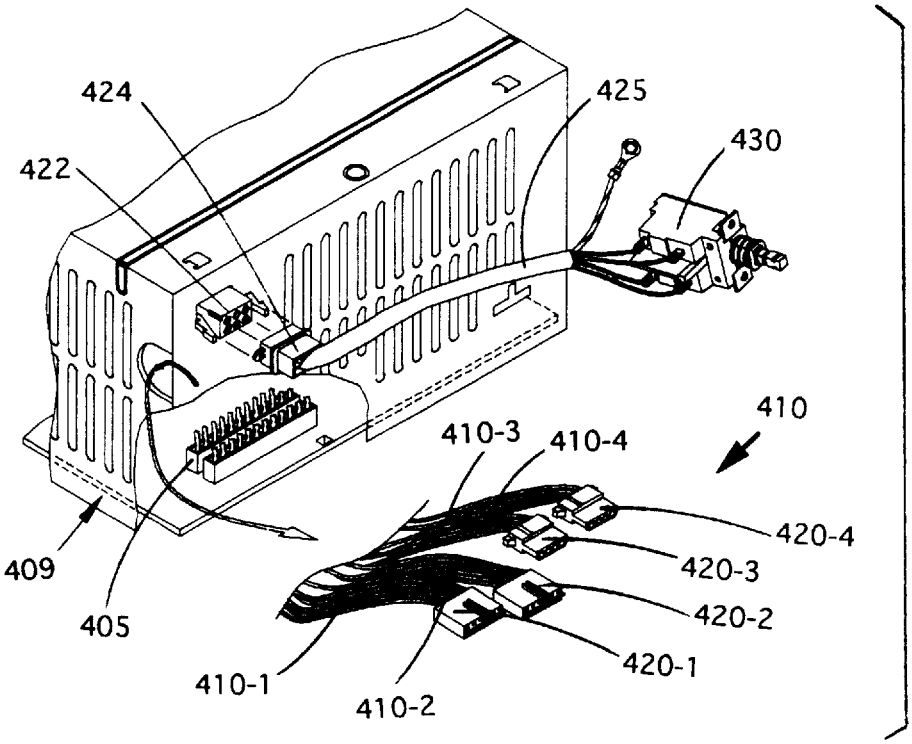
FIG. 6A is a partial perspective view of a power supply system according to another preferred embodiment of the present invention.
Figure 6B:
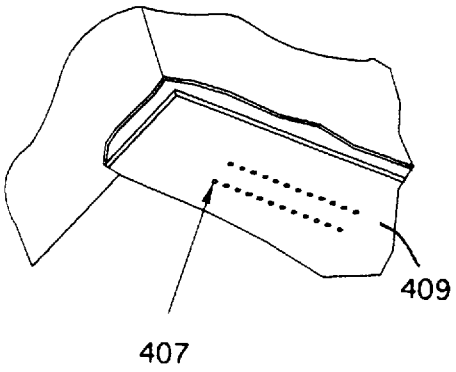
FIGS. 6B and 6C are partial perspective views of the soldering vias and the interface of the integrated PC receptive module to the output cables for the power supply system of FIG. 6A.
Figure 6C:
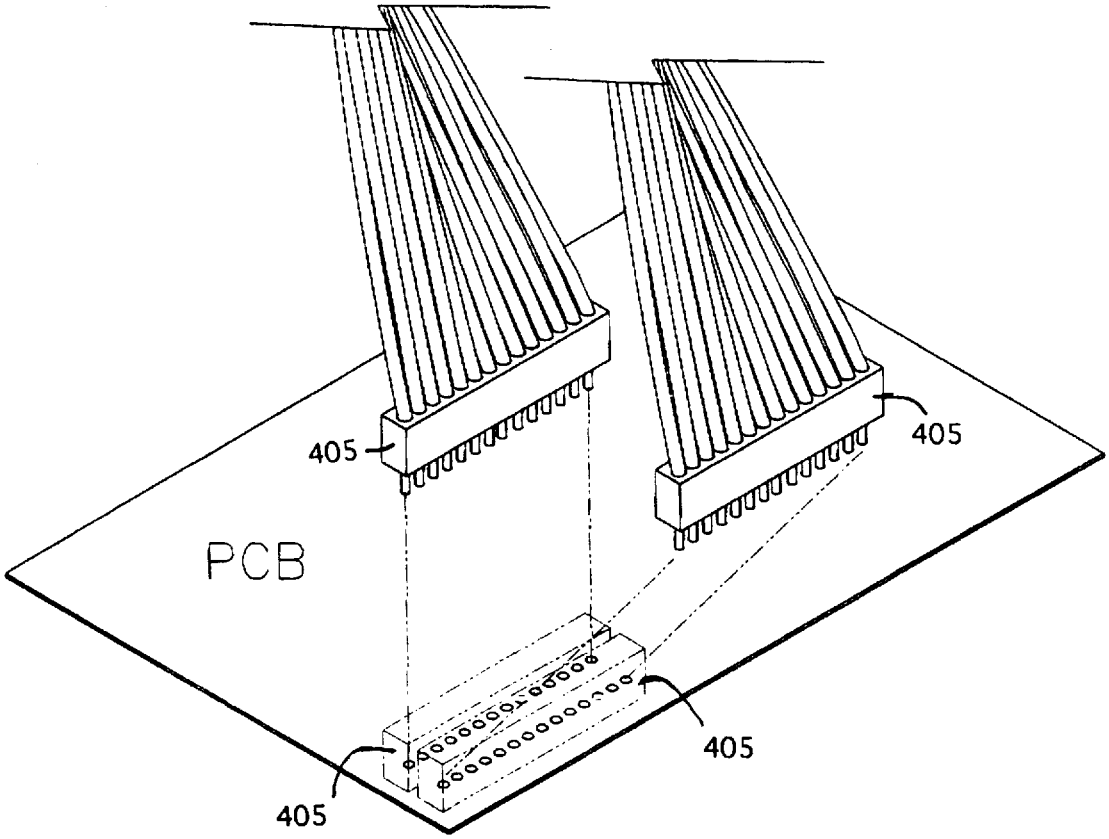

FIG. 6A shows a partial perspective view of a power supply system 400 of an alternate preferred embodiment of the present invention. The power supply system 400 includes an integrated personal-computer (PC) receptive module 405. The power supply system 400 also includes an O/P cable 410 which includes a plurality of power connecting lines grouped into several subsystem-cable groups, e.g., cable groups 410-1 to 410-4 wherein the power connecting lines in each subsystem cable group have two ends. In the first end, for each of these power connecting lines, the integrated PC receptive module 405 has a corresponding soldering via 407 (please refer to FIGS. 6B and 6C). Each of these power connecting lines in each subsystem groups are designed pass through a corresponding soldering via 407 from the top of the printed circuit board (PCB) 409 to be soldered to the circuits on the PCB 409. On the second end, the power connecting lines in each subsystem cable group are integrated and connected to a subsystem power plug module, e.g., power plug modules 420-1 to 420-4. The subsystem power plug module, i.e., modules 420-1 to 420-4, are then employed for plugging into a corresponding subsystem (not shown), such as a hard disk drive, a monitor, etc. for providing the required power for system operation.

The power supply system 400 further includes a power cable receptive module 422, a power cable 425, and an external power receptive module 430. The power cable 425 is connected to the power supply system 400 through the power receptive module 422 and the power cable plugging module 424 at one end, which is connected to the external power source (not shown) on the other end in same manner as that shown and described for FIGS. 3 and 4. The details of the power cable connection are therefore not further described here.

Referring to FIGS. 6A to 6C again, the power supply system 400 according to the present invention includes the integrated O/P PC receptive module 405 wherein a soldering via 407 is provided for each power line for soldering on to the PCB. Also, the power cable receptive module 422 coupled with the power cable plugging module 424 are provided for connecting the power supply 400 to the external power source (not shown). This system configuration allows the power system designer to more flexibly respond to customer requirements. The power supply module can be designed and manufactured in advance with a standard power cable receptive module 422 and a standard integrated PC receptive module 405. The integrated PC receptive module can be designed with standard pattern for soldering vias 407 ready to provide electric connecting of the power lines to the standard circuits on the PCB 409 which are arranged to provide different level of voltages as often required in supplying power to different subsystems and peripherals of a personal computer. Depending on customer's specification for the power supply to be used with different model of personal computers, these requirements are then satisfied by specifically designing and manufacturing the O/P cable 410 and the power cable 425. The O/P cable is designed with different subsystem groups 410-1, 410-2, . . . 410-4, etc. having different lengths and combination of connecting lines which are connected to the integrated subsystem power plugging modules 420-1, 420-2, . . . 420-4, etc. for plugging into different subsystems. The power cable 125 are designed with different length as each model of personal computers may require. The manufacture of the power supply 400 is completed by passing each of the power connecting lines through a corresponding soldering via 407 and then soldering the connecting lines to the PCB 409.

The present invention thus discloses a personal computer (PC) power supply system 400 for providing power from an external power source to a plurality of PC subsystems. The power supply system 400 includes a power cable 425 for connecting the power supply system 400 to the external power source. The power supply system 400 further includes an output (O/P) cable 410 having a first end and second end. The O/P cable 410 including a plurality of cable groups 410-1, 4102, . . . 410-4, etc., wherein each of the cable groups including a subsystem plug module 420-1, 420-2, 420-3, . . . etc., on the first end for connecting to a corresponding PC subsystem. The power supply system 400 further includes an integrated PC receptive module 405 including a plurality of connecting means 407 for providing an interface with the O/P cable 405 for establishing an electric connection with the O/P cable. The O/P cable 405 of the power supply system 400 may be independently and separately designed and manufactured for connection to different types of the personal computers. In one of the preferred embodiment, the plurality of connecting means 407 of the integrated PC receptive module 405 are standardized suitable for providing power to many different types for the PC subsystems by utilizing different designs and combinations of the O/P cable groups 410, 410-2, 410-3, . . . etc. In yet another preferred embodiment, the plurality of connecting means 407 of the integrated PC receptive module 405 are standardized patterns of soldering vias 407 for soldering the O/P cable 405 to a printed circuit board (PCB) 409 included in the PC power supply system 400.

The present invention thus discloses a method for designing and manufacturing a personal computer (PC) power supply system 400 for providing power to a plurality of PC subsystems from an external power source. The method includes the steps of (a) designing and manufacturing a power supply system 400 with an integrated PC receptive module 405 providing a plurality of standard connection means, e.g., the soldering vias 407 therein; (b) receiving a personal computer system specification defining a plurality of PC subsystems and corresponding subsystem power requirements; and (c) designing and manufacturing an output (O/P) cable 410 wherein (i) the O/P cable 410 including a plurality of O/P cable groups 410-1, 410-2, . . . 410-4, etc., according to the PC system specification and the subsystem power requirements, and (ii) each of the power connecting lines included in the O/P cable is ready to be connected to a corresponding connecting means, e.g., to be soldered to a corresponding soldering via 407 to be electrically connected to a PCB 409 of the power supply system 400.

In another preferred method for designing and manufacturing the PC power supply system the step (a) may further a step of designing and manufacturing the OP cable receptive module with standardized pattern of the connecting means, e.g., a standard pattern of the soldering vias suitable for providing power to many different types for the PC subsystems by utilizing different designs and combinations of the O/P cable groups. In another preferred method for designing and manufacturing the PC power supply system the step (a) may further include a step of designing and manufacturing the power supply system with a power cable receptive module; and the step (c) may further include a step of designing and manufacturing a power cable with a power cable plugging module for plugging the power cable into the power cable receptive module.

The above design and manufacture processes provide several advantages. First, it decrease the design and manufacture cost by standardize the basic unit of the power supply system. Cost savings can be achieved without requiring to re-design the major part of the power supply system. Secondly, by standardizing the design and manufacturing process, better and more stable quality control can be consistently performed with less variations between different product lines to be tested and controlled. Thirdly, by dividing the entire process into two major stages, i.e., the basic standard basic unit and the customized cable, more flexibility is provided for the power supply designer and manufacturer to better respond to different customer's requirements. This is because of the fact that the design and manufacture of the cables are generally easier and can be completed in shorter time. The production bottleneck which often encountered in the conventional process in requiring customized power supply system for in order to be compatible with many different kinds of computer configurations is therefore resolved by the present invention.

The present invention discloses a new and non-obvious system configuration and design method to provide a modularized and integrated cable interface for the personal computer power supply system. The disclosed modularized and integrated cable interface may appear to be well known in other fields of design and manufacture of the electronic products, it is nevertheless new and non-obvious in the field of the power supply for personal computer for several reasons explained below.

First of all, the modularized and integrated cable interfaces are commonly employed in design and manufacture of many electronic products for the major reason of operational flexibility, i.e., for the ease of installation, connecting and disconnecting among several subsystems or operational devices. Such interface configurations are intended for the benefits of the end users. In contrast, the modularized and integrated interface configuration as disclosed in this invention are employed as a processing steps for allowing flexibility in design and manufacture. The target groups between those of other electronic products with the integrated and modularized cable interface and of this invention are entirely different and thus have different purposes and requirements. The techniques which may be well known and obvious for one one target group, e.g., the end user, may not be so for a different group, e.g., the power supply system designers, because the intended use and potential benefits are entirely different.

Secondly, the trend of computer industry is moving toward more complex system as the CPU and the expanding storage capacity are capable of supporting more peripherals to perform more functions. The design of the power supply system is required to catch up with the latest development. The interest and the requirements of the computer manufacturers, i.e., the purchaser and the 'end-users'of the power supply system, is driving the power supply system to satisfy more different kinds of system configurations. The trend and the design requirements are in contradiction to integration and standardization. A 'blind spot'is thus formed in the art of power supply system design to implement a modularized and integrated cable interface as that are available for many other electronic products.

Thirdly, the design and manufacture of the power supply system are 'driven'instead of 'leading'by the requirements of the computer system design. The art of system design of the power supply is often in a 'responsive'and 'reaction'mode since the technology is typically more conventional. Without the demand and requirements from the purchaser and computer system designers, the concept of a modularized and integrated cable interface system, as disclosed in the present invention, is generally not considered even though there are similar configurations implemented in many other electronic products.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

I claim:

1. A method for designing and manufacturing a personal computer (PC) power supply system for providing power to a plurality of PC subsystems from an external power source comprising the steps of:

(a) designing and manufacturing a power supply system, before receiving a system specification for a specific type of personal computer, wherein said power supply system includes a standard integrated PC receptive module for providing a standard cable connection for connected to a plurality types of output (O/P) cables employed by a plurality types of personal computers;

(b) receiving a system specification defining a plurality of PC subsystems and corresponding subsystem power requirements for a customer designated type of personal computer among said plurality types of personal computers; and (c) designing and manufacturing an output (O/P) cable wherein (i) said O/P cable including a plurality of O/P cable groups according to said PC system specification and said subsystem power requirements for said customer designated type of personal computer, and (ii) said O/P cable including an integrated O/P cable plugging module for plugging said O/P cable into said standard integrated PC receptive module.

2. The method for designing and manufacturing said PC power supply system of claim 1 wherein:

said step (a) further including a step of designing and manufacturing said standard integrated OP cable receptive module with standardized pin configurations suitable for providing power to said plurality types of personal computers.

3. The method for designing and manufacturing said PC power supply system of claim 2 wherein:

said step (a) further including a step of designing and manufacturing said power supply system with a standard power cable receptive module; and said step (c) further including a step of designing and manufacturing a power cable with a standard power cable plugging module for plugging said power cable into said power cable receptive module.

4. A method for designing and manufacturing a personal computer (PC) power supply system for providing power to a plurality of PC subsystems from an external power source comprising the steps of:

(a) designing and manufacturing a power supply system, before receiving a system specification for a specific type of personal computer, wherein said power supply system includes a standard integrated PC receptive module including a plurality of standard connection means therein for providing a standard cable connection for connected to a plurality types of output (O/P) cables employed by a plurality types of personal computers;

(b) receiving a personal computer system specification defining a plurality of PC subsystems and corresponding subsystem power requirements for a customer designated type of personal computer among said plurality types of personal computers; and (c) designing and manufacturing an output (O/P) cable thus making said O/P cable to include a plurality of O/P cable groups according to said PC system specification and said subsystem power requirements for said customer designated type of personal computer, and also making said O/P cable compatible and ready to be connected to said plurality of standard connecting means on said integrated PC receptive module.

5. The method for designing and manufacturing said PC power supply system of claim 4 wherein:

said step (a) further including a step of designing and manufacturing said O/P cable receptive module with standardized pattern of soldering vias for soldering said O/P cable to a PCB included in said power supply system thus making said power supply system suitable for providing power to many different types for said PC subsystems by utilizing different designs and combinations of said O/P cable groups.

6. A method for designing and manufacturing a personal computer (PC) power supply system for providing power to a plurality of PC subsystems from an external power source comprising the steps of:

(a) designing and manufacturing a power supply system, before receiving a system specification for a specific type of personal computer, wherein said power supply system includes a standard PC receptive means for providing a standard cable connection for connected to a plurality types of output (O/P) cables employed by a plurality types of personal computers.

7. The method for designing and manufacturing said PC power supply system of claim 6 further comprising:

(b) receiving a system specification defining a plurality of PC subsystems and corresponding subsystem power requirements for a customer designated type of personal computer among said plurality types of personal computers; and (c) designing and manufacturing an output (O/P) cable with said O/P cable includes a plurality of O/P cable groups according to said PC system specification and said subsystem power requirements for said customer designated type of personal computer, and with said O/P cable includes a standard O/P cable connecting means for connecting said O/P cable to said standard PC receptive means.

8. The method for designing and manufacturing said PC power supply system of claim 6 wherein:

said step (a) further including a step of designing and manufacturing said standard O/P cable receptive means with standardized connection pin configurations suitable for providing power to said plurality types of personal computers.

9. The method for designing and manufacturing said PC power supply system of claim 6 wherein:

said step (a) further including a step of designing and manufacturing said power supply system with a standard power cable receptive module.

10. The method for designing and manufacturing said PC power supply system of claim 7 wherein:

said step (c) further including a step of designing and manufacturing a power cable with a standard power cable plugging module for plugging said power cable into said power cable receptive module.

* * * * *